US009903056B2

(12) United States Patent
Koike et al.

(10) Patent No.: US 9,903,056 B2
(45) Date of Patent: Feb. 27, 2018

(54) FEED DOG ADJUSTMENT DEVICE AND SEWING MACHINE INCLUDING SAME

(71) Applicant: Janome Sewing Machine Co., Ltd., Hachioji-Shi, Tokyo (JP)

(72) Inventors: Mikio Koike, Hachioji (JP); Yu Noji, Hachioji (JP)

(73) Assignee: JANOME SEWING MACHINE CO., LTD., Tokyo (JP)

( * ) Notice: Subject to any disclaimer, the term of this patent is extended or adjusted under 35 U.S.C. 154(b) by 45 days.

(21) Appl. No.: 15/132,615

(22) Filed: Apr. 19, 2016

(65) Prior Publication Data

US 2017/0121878 A1 May 4, 2017

(30) Foreign Application Priority Data

Oct. 30, 2015 (JP) ..... 2015-214666

(51) Int. Cl.
*D05B 27/08* (2006.01)
*D05B 27/24* (2006.01)

(52) U.S. Cl.
CPC ..... *D05B 27/08* (2013.01); *D05B 27/24* (2013.01)

(58) Field of Classification Search
CPC ..... D05B 27/00; D05B 27/02; D05B 27/06; D05B 27/08; D05B 27/24
See application file for complete search history.

(56) References Cited

U.S. PATENT DOCUMENTS 2,005,673 A * 6/1935 Eames ..... D05B 3/02 112/444
4,527,497 A * 7/1985 Kerr ..... D05B 27/08 112/313
4,674,426 A * 6/1987 Kasuda ..... D05B 27/08 112/313
4,756,263 A * 7/1988 Sano ..... D05B 27/02 112/315
5,337,689 A * 8/1994 Tilders ..... D05B 27/08 112/323
5,477,796 A * 12/1995 Nedoschinsky ..... D05B 27/02 112/323
2006/0090681 A1* 5/2006 Ota ..... D05B 19/16 112/459

FOREIGN PATENT DOCUMENTS

JP 6-28579 U 7/1994

* cited by examiner

*Primary Examiner* — Ismael Izaguirre
(74) *Attorney, Agent, or Firm* — Westerman, Hattori, Daniels & Adrian, LLP

(57) ABSTRACT

The feed dog adjustment device, includes a feed rock shaft rotatably attached to a sewing machine frame with an eccentric shaft provided at an eccentric position with respect to a center, a feed rock shaft crank that slides about the feed rock shaft, a feed bar rotatably attached to the feed rock shaft crank, a feed dog provided on the feed bar, an actuator for inclination adjustment that rotates the eccentric shaft, and a controller that drives the actuator for inclination adjustment to adjust an inclination of the feed dog on a basis of data related to a type and stretchability of fabric.

12 Claims, 15 Drawing Sheets

FEED DOG ADJUSTMENT DEVICE AND SEWING MACHINE INCLUDING SAME

BACKGROUND OF THE INVENTION

1. Field of the Invention

The present disclosure relates to a feed dog adjustment device and a sewing machine that includes the adjustment device that adjusts an inclination of a feed dog of a sewing machine and, particularly, relates to a feed dog adjustment device and a sewing machine including the adjustment device that adjusts an inclination of a feed dog in accordance with the type and the state of a sewn fabric, 2. Description of the Related Art Conventionally, it is widely known that, when sewing with a sewing machine, the inclination of the feed dog that transfers a piece of fabric by interlocking with the vertical motion of a needle has an effect on the result of the sewn object. Typically, when considering stability of the fabric feed, it is desirable that the feed dog is oriented in a horizontal manner; however, in a case of a piece of fabric with a high degree of stretchability, such as a knit fabric, seams easily occur by sewing slippage caused by the lower cloth being fed more than the upper cloth. In such a case, sewing slippages can be suppressed by inclining the feed dog such that the feed dog becomes lower towards the front side (hereinafter, referred to as "downward toward the front") of the operator.

Furthermore, in a case of a piece of fabric, such as a georgette or a satin, or a piece of fabric with a relatively small degree of stretchability in which shrinkage by sewing easily occurs during sewing, the shrinkage by sewing and shrinking can be suppressed by inclining the feed dog such that the feed dog becomes higher towards the front side (hereinafter, referred to as "upward toward the front") of the operator. Furthermore, in a case of a piece of lightweight fabric, it is known that lowering the height of the feed dog (hereinafter, referred to as "feed dog height") that protrudes from the upper surface of the needle plate is effective in preventing shrinkage by sewing and, on the other hand, it is known that in a case of a piece of heavyweight fabric, sewing is easier when the height of the feed dog is high.

As a feed dog device of a sewing machine that, is capable of adjusting the inclination of the feed dog in accordance with the sewing condition, a feed dog device is conventionally known that includes a feed bar to which a feed dog is fixed, and a swinging mechanism that is connected to the feed bar and that gives fabric feed motion to the feed dog. By connecting the feed bar and the swinging mechanism with an eccentric pin, the inclination of the feed dog is adjusted (see CD-ROM of Japanese Utility Model Registration Application No. 4-56909 (Japanese Unexamined Utility Model Registration Application Publication No. 6-48579), for example).

SUMMARY OF THE INVENTION

However, in the feed dog device of the sewing machine described in CD-ROM of Japanese Utility Model Registration Application No. 4-56909 (Japanese Unexamined Utility Model Registration Application Publication No. 6-48579), the operator needs to determine the property of the fabric, such as the type and the stretchability, and needs to manually adjust the inclination of the feed dog by rotating the eccentric pin; accordingly, onerous work has to be disadvantageously performed. Furthermore, while it is desirable that the height of the feed dog is adjusted in accordance with the thickness of the fabric, the feed dog device of the sewing machine described in CD-ROM of Japanese Utility Model Registration Application No. 4-56909 (Japanese Unexamined Utility Model Registration Application Publication No. 6-48579) is not capable of adjusting the inclination of the feed dog together with the height of the feed dog by adjusting the inclination of the feed dog alone.

The present disclosure sets to overcome the above problems and an object thereof is to provide a feed dog adjustment device and a sewing machine including the feed dog adjustment device that are capable of, without onerous manual work of the user, preventing seam puckering caused by sewing slippage and shrinkage by sewing from occurring by having a controller adjust an inclination of a feed dog by driving an actuator. Furthermore, the present disclosure is capable of preventing seam puckering from occurring in a further reliable manner by adjusting both the inclination and the height of the feed dog. Furthermore, an object thereof is to provide a feed dog adjustment device and a sewing machine that includes the adjustment device that provide a simple user operation by automatically determining the property of the fabric on the basis of information from a sensor and the like.

In order to overcome the above problems, the present disclosure is a feed dog adjustment device, including a feed rock shaft rotatably attached to a sewing machine frame with an eccentric shaft provided at an eccentric position with respect to a center, a feed rock shaft crank that slides about the feed rock shaft, a feed bar rotatably attached to the feed rock shaft crank, a feed dog provided on the feed bar, an actuator for inclination adjustment that rotates the eccentric shaft; and a controller that drives the actuator for inclination adjustment to adjust an inclination of the feed dog on a basis of data related to a type and stretchability of fabric.

A specific exemplary embodiment of the feed dog adjustment device further includes a lower shaft rotatably attached to the sewing machine frame, a vertically moving cam that includes a plurality of earn surfaces that have different largest cam diameters and that is fitted around the lower shaft so as to be slidable in an axial direction of the lower shaft, the vertically moving cam supporting and vertically swinging the feed bar, a sub feed bar rotatably attached to the feed bar, the feed dog being fixed to the sub feed bar, a sub vertically moving cam that includes a plurality of cam surfaces that have different largest cam diameters and that is fitted around the lower shaft so as to be slidable in the axial direction of the lower shaft, the sub vertically moving cam supporting and vertically swinging the sub feed bar, and an actuator for height adjustment that slides the vertically moving cam and the sub vertically moving cam in the axial direction with respect to the lower shaft. In the feed dog adjustment device, a cam surface of the plurality of cam surfaces of the vertically moving cam that supports the feed bar and a cam surface of the plurality of cam surfaces of the sub vertically moving cam that supports the sub feed bar are capable of being selected.

In a further specific example of the feed dog adjustment device, the cam surface of the vertically moving cam that has been selected to support the feed bar and the cam surface of the sub vertically moving cant that has been selected to support the sub feed bar are formed such that a vertical motion of a rotation center of the sub feed bar on the feed bar and a vertical motion of a contact between the sub vertically moving cam and the sub feed bar are coincident with respect to each other in quantity and in phase, or the further specific example of the feed dog adjustment device further includes a presser bar mounted in the sewing machine frame so as to be capable of sliding vertically, a presser foot attached to a lower end portion of the presser bar; and a height detection sensor that acquires data related to a thickness of the fabric by detecting a height of the presser bar, in which the controller drives the actuator for height adjustment to control the height of the feed dog on a basis of data related to the thickness of the fabric.

A further specific exemplary embodiment of the feed dog adjustment device further includes a presser lever that presses the presser bar while having a spring in between, in which the controller calculates data on a difference between a descended amount of the presser lever when the presser bar compresses the fabric with the presser foot and a descended amount of the presser bar, and on a basis of the data that has been calculated, controls the inclination of the feed dog by driving the actuator for inclination adjustment. Furthermore, in order to resolve the above problems, a sewing machine of the present disclosure includes either one of the above feed dog adjustment devices.

In the feed dog adjustment device of the present disclosure, on the basis of data related to the type and stretchability of the fabric, in order to adjust the inclination of the feed dog, the controller drives the actuator for inclination adjustment that rotates the eccentric shaft, moves the feed rock shaft vertically, and vertically moves the swinging center of the feed rock shaft crank that supports the feed bar on which the feed dog is provided; accordingly, by operating an input device, such as a touch panel, the inclination of the feed dog can be adjusted and seam puckering caused by sewing slippage and shrinkage by sewing can be prevented from occurring without the need for an onerous manual work. Furthermore, in the exemplary embodiment that includes the actuator for height adjustment that slides, in the axial direction with respect to the lower shaft, the vertically moving cam and the sub vertically moving cam that include the plurality of cam surfaces that have different largest cam diameters and that support and vertically swing the feed bar and the sub feed bar, and that enables selection of a cam surface of the plurality of cam surfaces that support the feed bar and a cam surface of the plurality of cam surfaces that support the sub feed bar, in addition to the adjustment of the inclination of the feed dog, since the height of the feed dog can be adjusted, seam puckering caused by shrinkage by sewing and the like can be prevented from occurring in a further reliable manner. Furthermore, in the exemplary embodiment that includes a height detection sensor that acquires data relating to the thickness of the fabric by detecting the height of the pressor bar and in which, on the basis of the data related to the thickness of the fabric, the controller drives the actuator for height adjustment and adjusts the height of the feed dog, the feed dog can be adjusted easily by automatic detection of the fabric property.

BRIEF DESCRIPTION OF THE DRAWINGS

FIG. 5A is a drawing of a feed bar plate in contact with the largest cam diameter portion of the vertically moving earn surface, and FIG. 5B is a drawing of the feed bar plate in contact with the smallest cam diameter portion.

FIG. 6A is a drawing of a sub feed bar plate in contact with the largest earn diameter portion of the a sub vertically moving cam, and FIG. 6B is a drawing of the sub feed bar plate in contact with the smallest cam diameter portion.

FIG. 7A is a diagram illustrating a state in which the feed dog is oriented downward toward the front and FIG. 7B is a diagram illustrating a state in which the feed dog is oriented upward toward the front.

FIG. 8A is a diagram illustrating a state in which the height of feed dog is increased and FIG. 8B is a diagram illustrating a state in which the height of the feed dog is lowered.

FIG. 11A is a diagram illustrating a thickness of a piece of heavyweight fabric, FIG. 11B illustrates a thickness of an intermediate degree, and FIG. 11C illustrates a thickness of a piece of lightweight fabric.

DESCRIPTION OF THE PREFERRED EMBODIMENTS

A feed dog adjustment device and a sewing machine including the adjustment device of the present disclosure will be described next with reference to the drawings illustrating an exemplary embodiment.

Exemplary embodiment

Figure 1:
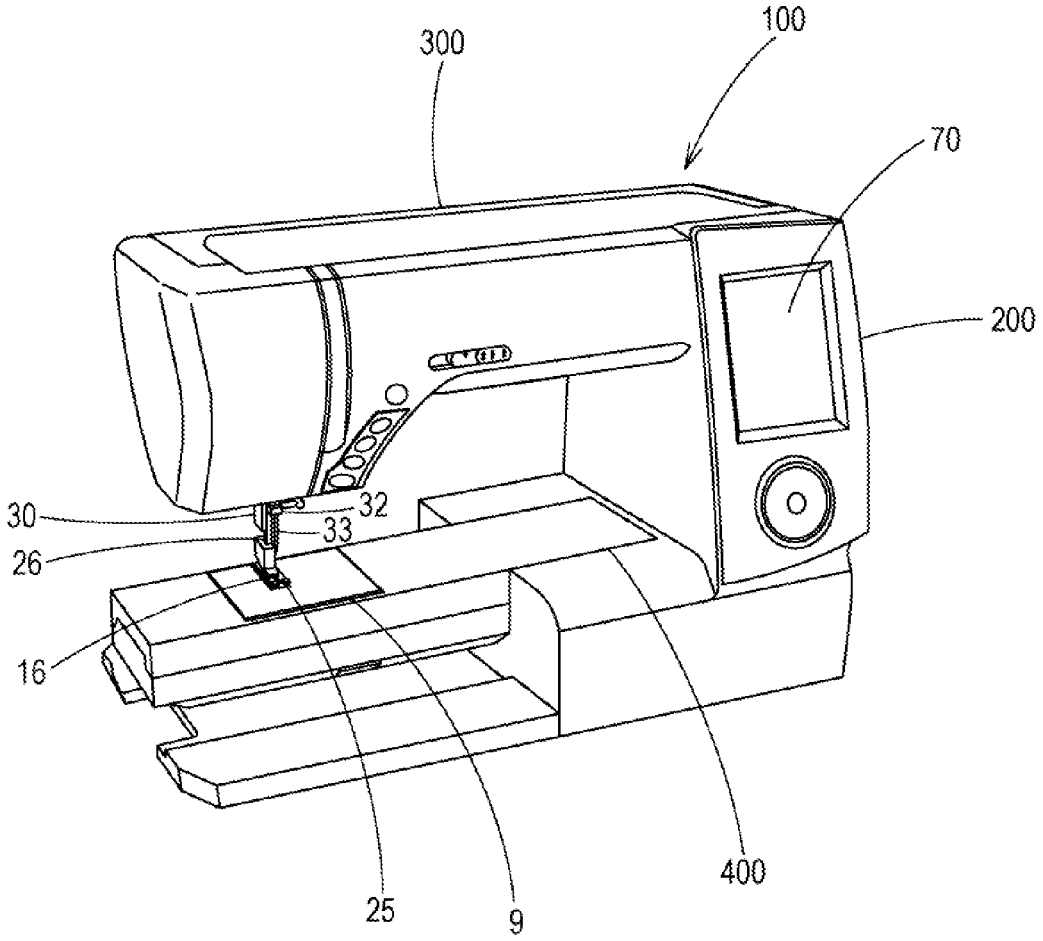
FIG. 1 is a perspective view of the entire sewing machine including a feed dog adjustment device of an exemplary embodiment of the present disclosure.

Referring to FIG. 1, reference numeral 100 is an upper frame of a sewing machine. The upper frame 100 includes a pillar portion 200 and an arm portion 300 that extends leftwards from the pillar portion 200. Reference numeral 400 is a bed portion and reference numeral 9 is a needle plate mounted on the upper surface of the bed portion 400. A touch panel 70 is provided on the front side of the pillar portion 200. A sewing needle 33 that is fixed to a needle bar 32 is inserted into a needle hole of the needle plate 9 upon vertical drive of an upper shaft motion mechanism accommodated inside the arm. portion 300. A piece of fabric N (see FIGS. 10 to 12) placed on the upper surface of the needle plate 9 is fed by a feed dog 16 that is driven so as to protrude and retract from the needle plate 9 with a lower shaft motion mechanism described later accommodated inside the bed portion 400. Reference numeral 26 is a pressor bar including a pressor foot 25 at the lower end. The pressor bar 26 presses the fabric N with the spring 28 described later such that, the fabric N is in close contact with the feed dog 16.

Figure 2:
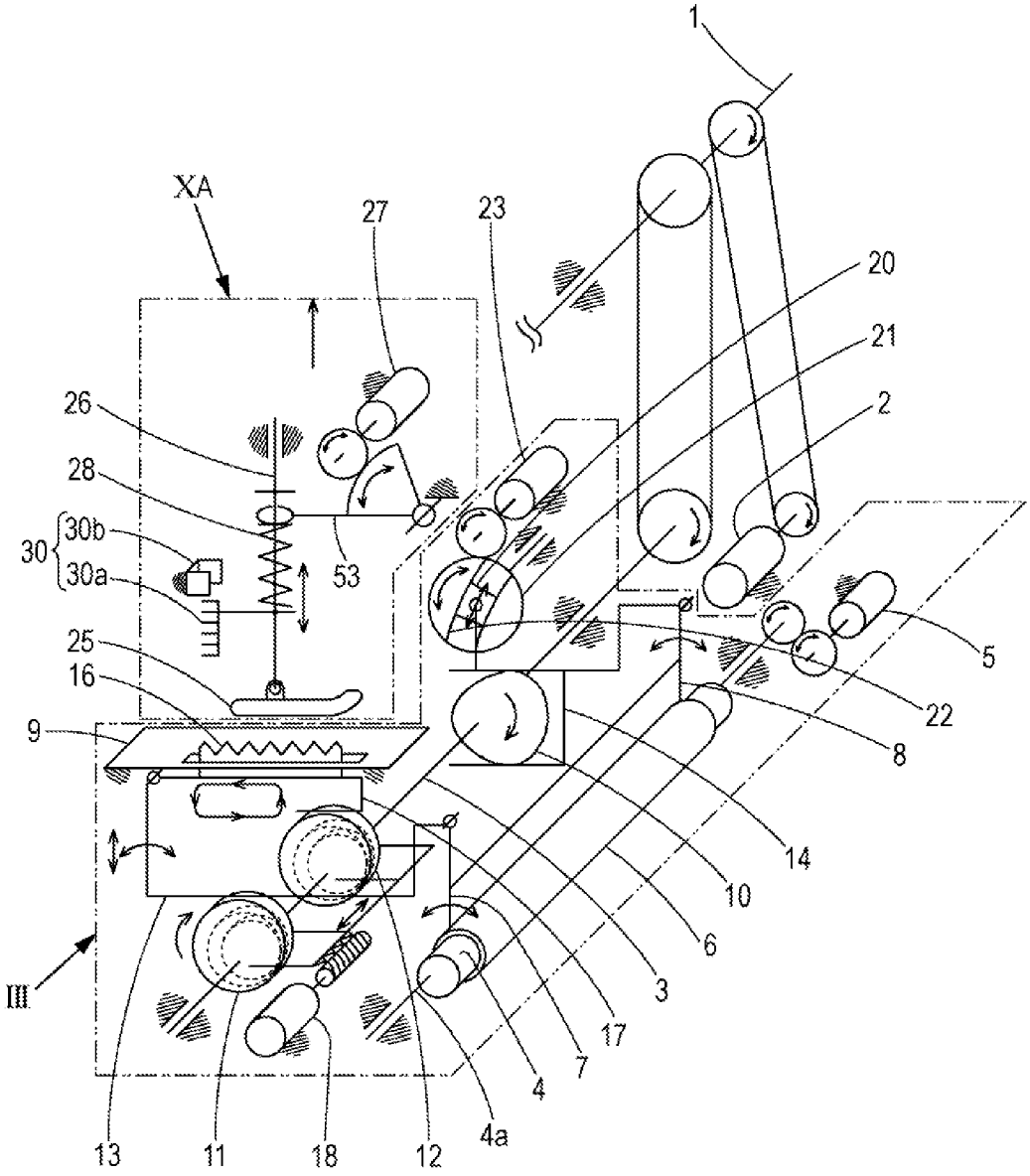
FIG. 2 is a drawing for describing the main configuration of a feed dog motion mechanism inside a body of the sewing machine of the exemplary embodiment.

A main configuration of a motion mechanism inside a sewing machine body will be described. In FIG. 2, reference numeral 1 is an upper shaft that is accommodated inside the arm portion 300 and that, is rotatably supported by a sewing machine frame. The upper shaft 1 is rotationally driven by a sewing machine motor 2 and transmits driving force to the needle bar 32 and the like. Reference numeral 3 is a lower shaft that, is accommodated inside the bed portion 400 and that is rotatably supported by the sewing machine frame. The lower shaft 3 includes a triangular cam 10, and a vertically moving cam 11 and a sub vertically moving cam 12 that integrally slide in the axial direction, and is rotationally driven while being interlocked with the rotation of the upper shaft 1. Reference numeral 4 is a feed rock shaft including, at both ends thereof, eccentric shafts 4*a* that have eccentric rotation centers. A bearing 6 for the feed rock shaft is loosely fitted around the outer peripheral of the feed rock shaft 4 in a rotational manner. The eccentric shafts 4*a* are rotatably supported by the sewing machine frame and are rotationally driven by a stepping motor 5 for adjusting the inclination of the feed dog.

Feed rock shaft cranks 7 and a horizontal swing arm 8 are integrally attached to the bearing 6 for the feed rock shaft. A feed bar 13 is rotationally connected to the feed rock shaft cranks 7, and a forked link 14 is rotationally connected to the horizontal swing arm 8. A sub feed bar 17 to which the feed dog 16 is fixed is rotationally attached to the feed bar 13, The feed bar 13 is in slide contact with a cam surface of the vertically moving earn 11, and the sub feed bar 17 is in slide contact with a cam surface of the sub vertically moving cam 12. The vertically moving cam 11 and the sub vertically moving cam 12 each include a plurality of earn surfaces that have different largest cam diameters and are moved by being integrally slid in the axial direction with respect to the lower shaft 3 with a stepping motor 18 for adjusting the height of the feed dog. With the above, the feed bar 13 and the sub feed bar 17 are capable of selectively coming into sliding contact with one of the plurality of cam surfaces of the vertically moving cam and one of the plurality of cam surfaces of the sub vertically moving cam, respectively.

In the forked link 14, a square piece 20 is pivotally supported, and the square piece 20 is engaged to a groove 22 of a horizontal feed adjuster 21. The horizontal feed adjuster 21 is rotatably supported by the sewing machine frame and is rotationally driven by a stepping motor 23 for the horizontal feed adjuster. The presser bar 26 to which the presser foot 25 is attached to the lower end is provided so as to be capable of sliding vertically with respect to the sewing machine frame and is driven vertically with a stepping motor 27 for driving the presser bar while having the spring 28 in between. A slit plate 30*a* is installed and fixed to the presser bar 26 and constitute a height detection sensor 30, which detects the height of the presser bar 26, together with a transmission optical sensor 30*b* fixed to the sewing machine frame.

Figure 3:
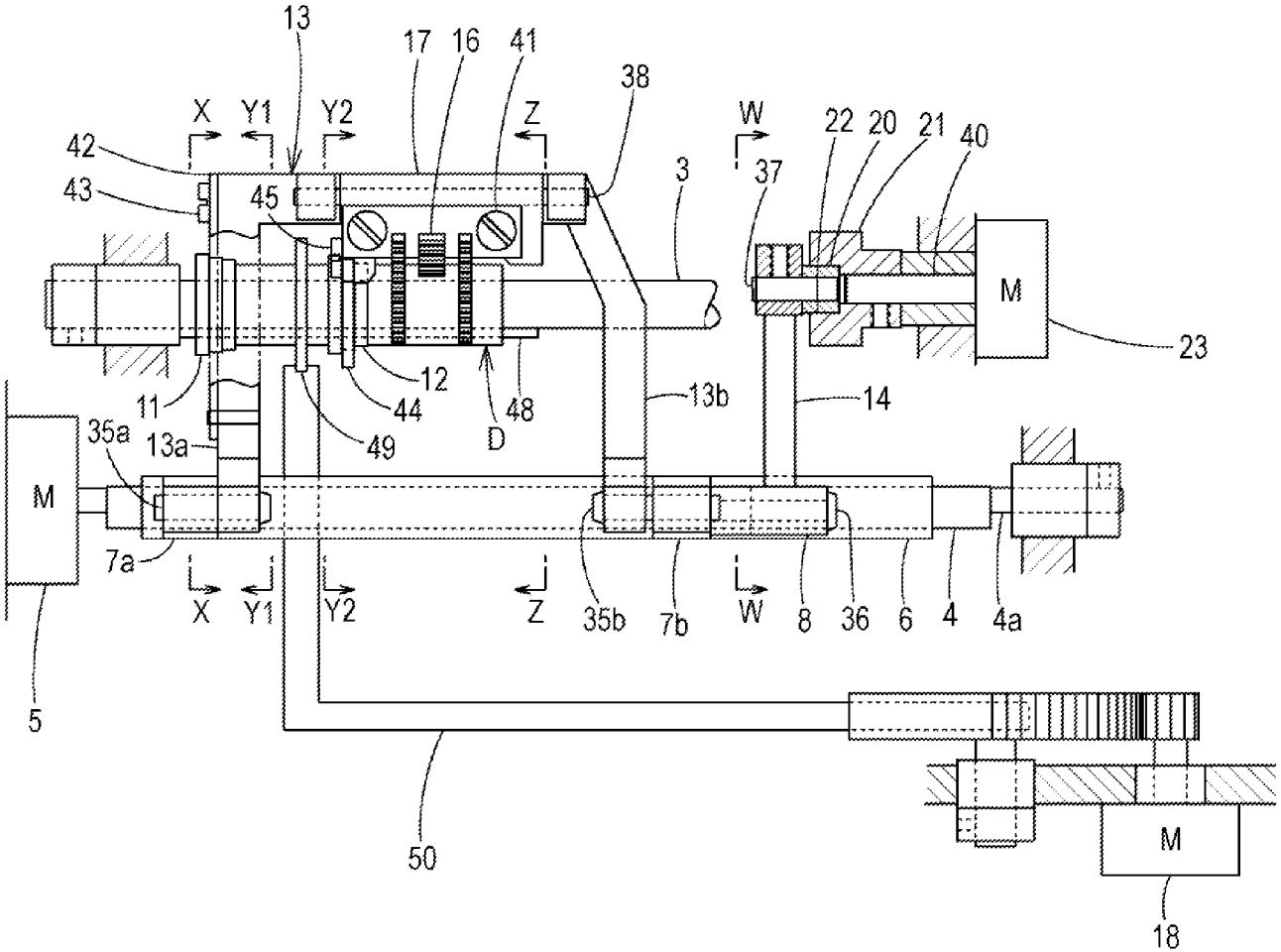
FIG. 3 is a top view of an essential portion (an essential portion III in FIG. 2) of the feed dog motion mechanism of the sewing machine of the exemplary embodiment.
Figure 4A:
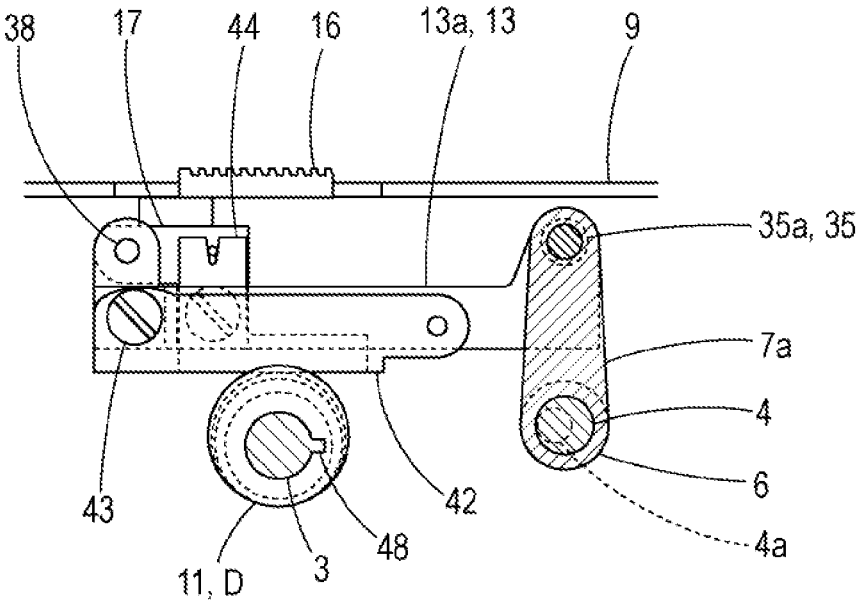
FIG. 4A is a cross-sectional arrow view taken along X-X in FIG. 3.
Figure 4B:
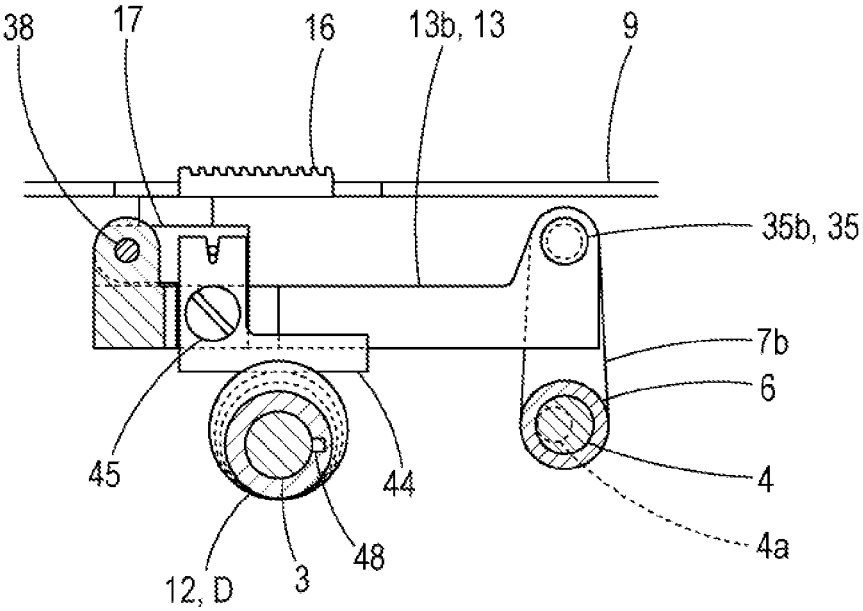
FIG. 4B is a cross-sectional arrow-view taken along Y2-Y2 in FIG. 3.

FIG. 3 illustrates an essential portion III in FIG. 2 and illustrates a lower feed mechanism of the sewing machine that feeds the fabric N by having the feed dog 16 move in the vertical direction and in the horizontal direction. A pair of feed rock shaft cranks 7 (7*a* and 7*b*) are integrally provided with the bearing 6 for the feed rock shaft, the bearing 6 being rotatably fitted around the outer periphery of the feed rock shaft 4, and arm portions 13*a* and 13*b* of the feed bar 13 are rotatably connected to portions near the distal ends of the feed rock shaft cranks 7*a* and 7*b* with pins 35*a* and 35*b*. Furthermore, the forked link 14 is rotatably connected with a pin 36 to a portion near the distal end of the horizontal swing arm 8 that is integrally provided with the bearing 6 for the feed rock shaft and that is connected to the feed rock shaft crank 7*b*.

Figure 9A:
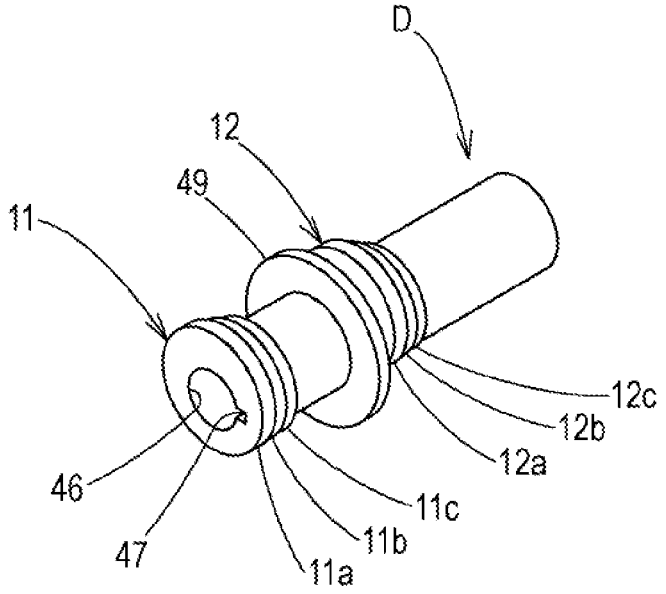
FIG. 9A is a perspective view of a cam body.
Figure 9B:
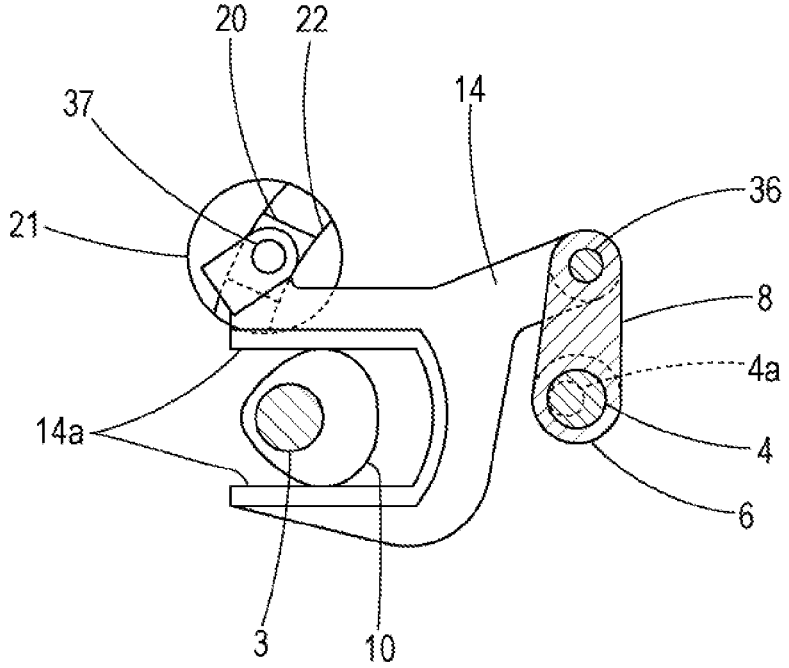
FIG. 9B is a cross-sectional arrow view taken along W-W in FIG. 3.

As illustrated in FIG. 9B, the triangular cam 10 that is fixed to the lower shaft 3 is engaged to the forked link 14 at a forked portion 14*a* of the forked link 14. The square piece 20 is attached to the portion near the distal end of the forked link 14 with a pin 37 in a rotatable manner, and the square piece 20 is engaged with the groove 22 of the horizontal feed adjuster 21 in a sizable manner. The horizontal feed adjuster 21 is fixed to a shaft 40 rotatably supported by the sewing machine frame and is rotationally driven by the stepping motor 23 for the horizontal feed adjuster.

As illustrated in FIGS. 3, and 4A to 8B, the sub feed bar 17 is rotatably connected to the feed bar 13 with a pin 38, and the feed dog 16 is fixed to the sub feed bar 17 with a screw 41. A feed bar plate 42 that abuts against and that is supported by the cam surface of the vertically moving cam 11 at the lower end is fixed to the arm portion 13*a* of the feed bar 13 with a screw 43. Furthermore, a sub feed bar plate 44 that abuts against and that is supported by the cam surface of the sub vertically moving cam 12 at the lower end is fixed to the sub feed bar 17 with a screw 45. The vertically moving cam 11 and the sub vertically moving cam 12 are integrally formed in a cam body D.

As illustrated in FIG. 9A, a spline groove 47 provided in a shaft hole 46 fits in a spline 48 provided in the lower shaft 3 such that the cam body D is capable of sliding in the axial direction with respect to the lower shaft 3. In the vertically moving cam 11 and the sub vertically moving cam 12, three cam surfaces 11*a*, 11*b*, and 11*c* and three cam surfaces 12*a*, 12*b*, and 12*c* that have different largest diameters from the rotation centers (the center of the lower shaft 3) to the cam surfaces, in other words, three cam surfaces 11*a*, 11*b*, and 11*c* and three cam surfaces 12*a*, 12*b*, and 12*c* that have different largest cam diameters are formed in a row in the axial direction, and with a sliding motion of the cam body D in the axial direction with respect to the lower shaft 3, either one of the cam surfaces 11*a*, 11*b*, and 11*c* of the vertically moving cam 11 and either one of the corresponding one of the cam surfaces 12*a*, 12*b*, and 12*c* of the sub vertically moving cam 12 can be selectively switched.

A flange portion 49 is provided in the portion near the center of the cam body D in the axial direction, and the flange portion 49 is engaged with a slide lever 50 that is driven by the stepping motor 18 for adjusting the height of the feed dog. Note that while in the present exemplary embodiment, the vertically moving cam 11 and the sub vertically moving cam 12 are integrally formed with the cam body D, the vertically moving cam 11 and the sub vertically moving cam 12 do not necessarily have to be formed integrally as above as long as both cams are driven in a coordinated manner allowing the plurality of cam surfaces to be selectively switched. Furthermore, each of the vertically moving cam 11 and the sub vertically moving cam 12 may be formed of a single cam surface.

Figure 10A:
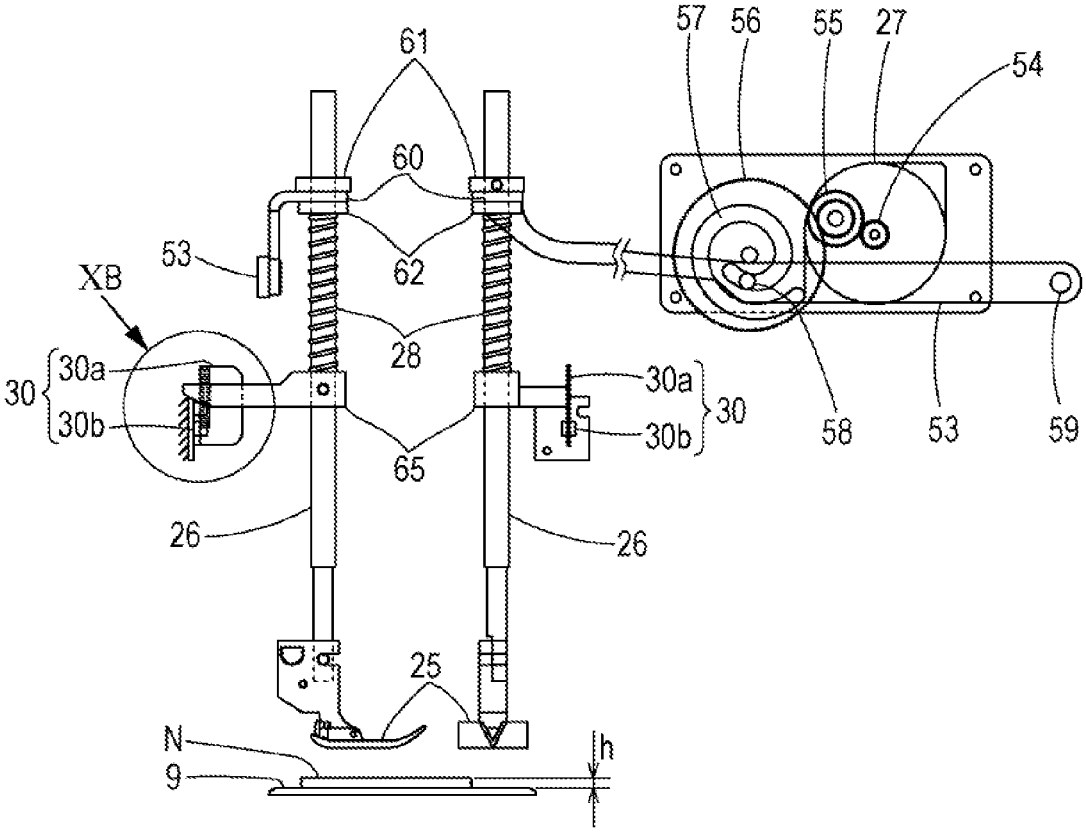
FIG. 10A is a front view illustrating a fabric thickness measuring unit that is an essential portion XA in FIG. 2.
Figure 10B:
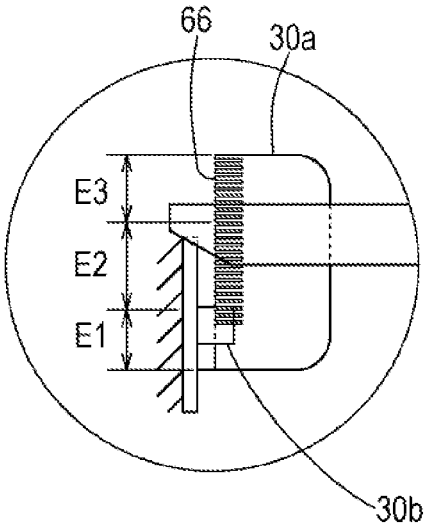
FIG. 10B is an enlarged view of an essential portion XB in FIG. 10A.
Figure 11A:
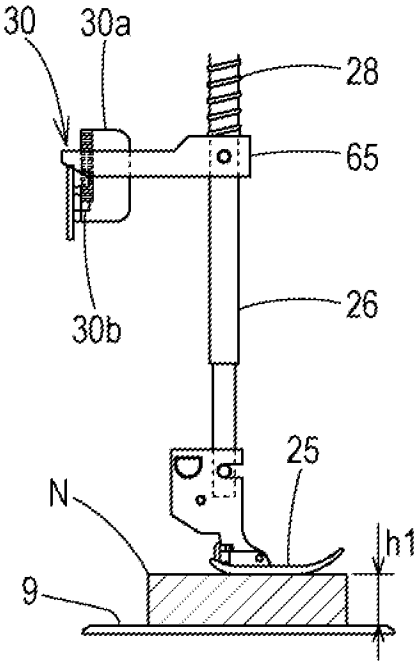
FIGS. 11A to 11C are diagrams illustrating states of a presser bar and a height detection sensor of the sewing machine of the exemplary embodiment in cases in which the fabric thicknesses are different.
Figure 11B:
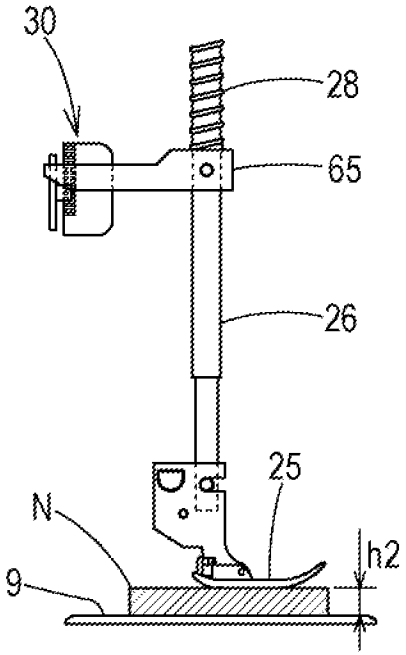
Figure 11C:
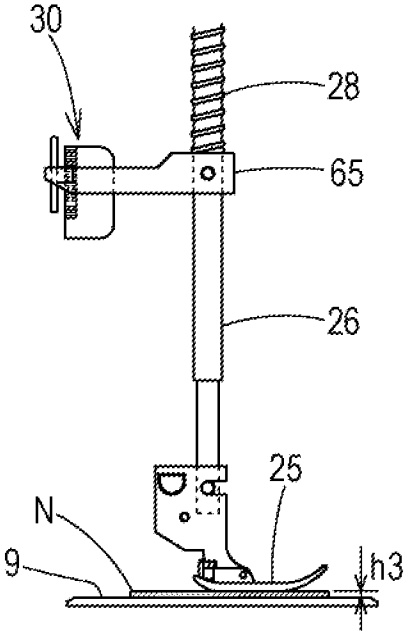

FIGS. 10A and 10B illustrate an essential portion XA in FIG. 2 and illustrates a fabric thickness measuring unit that measures a thickness h of the sewn fabric N by measuring the height of the presser bar 26. The presser foot 25 is attached to the lower end of the presser bar 26 provided so as to be capable of sliding in the vertical direction with respect to the sewing machine frame. The presser bar 26 is moved vertically by a presser lever 53 that is swung by the stepping motor 27 for driving the presser bar. A driving gear 54 is attached to the shaft of the stepping motor 27 for driving the presser bar, and the driving force of the stepping motor 27 is transmitted to a cam disc 56 through a double gear 55. A spiral cam groove 57 enlarging in the radial direction is provided in the cam disc 56, and a follower projection 58 provided in the presser lever 53 engages with the cam groove 57 in a slidable manner.

One end of the presser lever 53 is pivotally supported to the sewing machine frame with a pin 59 and extends in a lateral direction that is substantially orthogonal to the axis of the presser bar 26, and a ring portion 60 that, is fitted around the presser bar 26 in a slidable manner in the vertical direction is formed at the other end of the presser lever 53. An upper surface of the ring portion 60 is capable of engaging with a raising flange 61 that is fixed to the presser bar 26, and an underside of the ring portion 60 is capable of engaging with an upper surface of a washer 62 that, is capable of sliding on the presser bar 26 and that abuts against an upper end of the spring 28. A presser bar guide bracket 65 that includes a bearing surface that abuts against a lower end of the spring 28 and that extends outward in an arm-like shape having the slit plate 30*a* at the distal end is fixed to a portion near the middle of the presser bar 26.

As illustrated in FIG. 10B, slits 66 that penetrate the slit plate 30*a* in the thickness direction throughout a predetermined height range is formed in the slit plate 30*a*, and the transmission optical sensor 30*b* provided with an emitter and a receiver in which the slit plate 30*a* is interposed therebetween is attached to the sewing machine frame. By detecting light transmitting through the slits 66 of the slit plate 30*a*, the transmission optical sensor 30*b* is capable of detecting the height position of the presser bar 26, and by counting the number of slits that has passed through the receiver of the transmission optical sensor 30*b*, the transmission optical sensor 30*b* is capable of detecting the ascended amount or the descended amount of the presser bar 26.

Figure 13A:
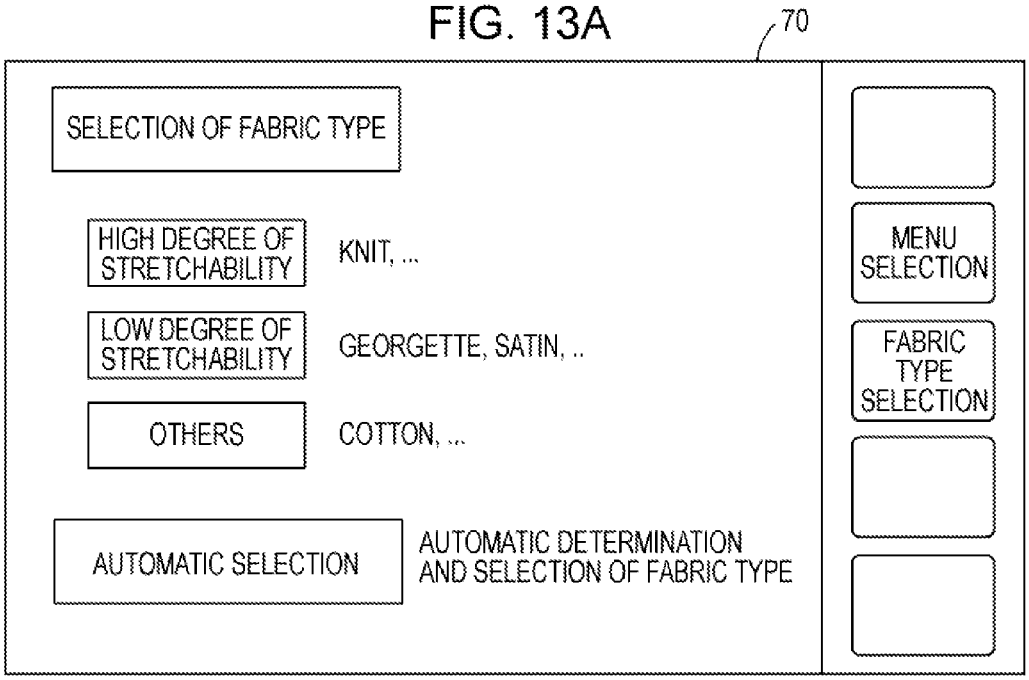
FIG. 13A is an example of a display of the touch panel of the sewing machine of the exemplary embodiment.
Figure 13B:
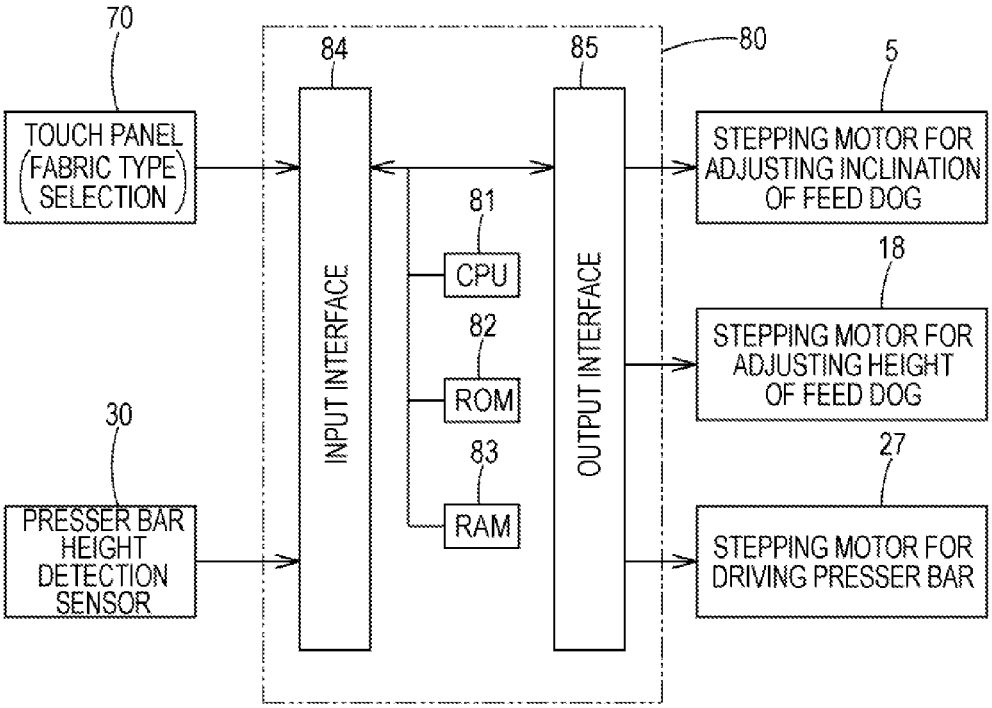
FIG. 13B is a block diagram of the control system.

Various operations, functions, and messages that are required for the sewing work are displayed on the touch panel 70 provided in the pillar portion 200 of the sewing machine body, and as illustrated in FIG. 13A, by performing a touch operation on the display "FABRIC TYPE SECTION" of the menu illustrated in FIG. 13A, adjustment of the inclination of the feed dog 16 can be performed according to the type and stretchability of the sewn fabric N. Furthermore, as illustrated in FIG. 13B, a controller 80 is provided in the sewing machine body, and the controller 80 includes a microcomputer including a CPU 81, ROM 82, and a RAM 83, an input interface 84, and an output interface 85. The touch panel 70 and the height detection sensor 30 are connected to the input interface 84, and the stepping motor 5 for adjusting the inclination of the feed dog, the stepping motor 18 for adjusting the height of the feed dog, and the stepping motor 27 for driving the presser bar are connected to the output interface 85.

Use modes and effects of the present embodiment will be described next. The feed dog 16 that is fixed to the sub feed bar 17 having a rotation center in the feed bar 13 is moved in the horizontal direction by swinging and rotation of the bearing 6 for the feed rock shaft and is moved in the vertical direction by rotations of the vertically moving cam 11 and the sub vertically moving cam 12. As described subsequently, the horizontal motion and the vertical motion both occur by interlocking to the rotation of the lower shaft 3. The feed dog 16 moves in a substantially elliptical manner while protruding and retracting with respect to the upper surface of the needle plate 9 and transfers the fabric SSI in the sewing direction.

As illustrated in FIG. 9B, when the forked link 14 is about to swing in the vertical direction upon rotation of the triangular cam 10 that is fixed to the lower shaft 3, since the square piece 20 that is connected to the forked link 14 with the pin 37 is engaged with the groove 22 of the horizontal feed adjuster 21 in a slidable manner, the forked link 14 is restricted towards the sliding direction of the square piece 20 and swings in the horizontal direction as well. As a result, the forked link 14 swings the horizontal swing arm 8 that is connected thereto with the pin 36, and the bearing 6 for the feed rock shaft that is integral with the horizontal swing arm 8 is swung and rotated about the outer periphery of the feed rock shaft 4. When the horizontal feed adjuster 21 is rotationally driven by the stepping motor 23 (see FIGS. 2 and 3) for adjusting the horizontal feed, the angle of inclination of the groove 22 changes, and in accordance with the change in the angle of inclination of the groove 22, the swinging amount of the bearing 6 for the feed rock shaft is determined; accordingly, the horizontal feed amount of the feed dog 16 can be adjusted.

Figure 5A:
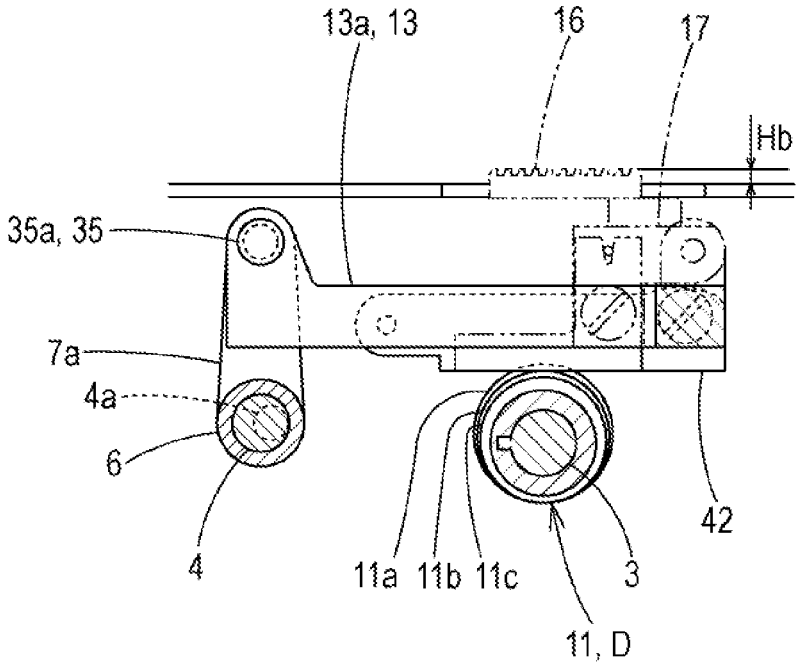
FIGS. 5A and 5B are cross-sectional arrow views taken along Y1-Y1 in FIG. 3.
Figure 5B:
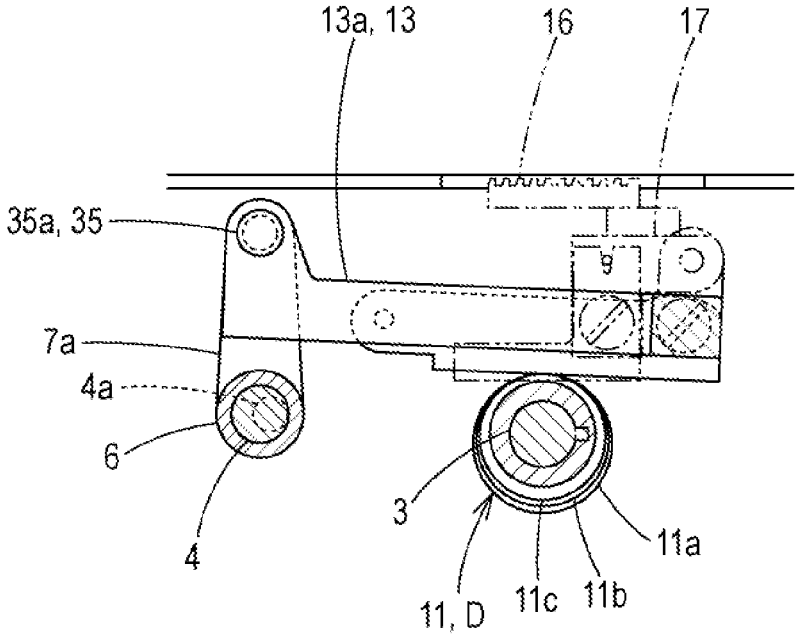
Figure 6A:
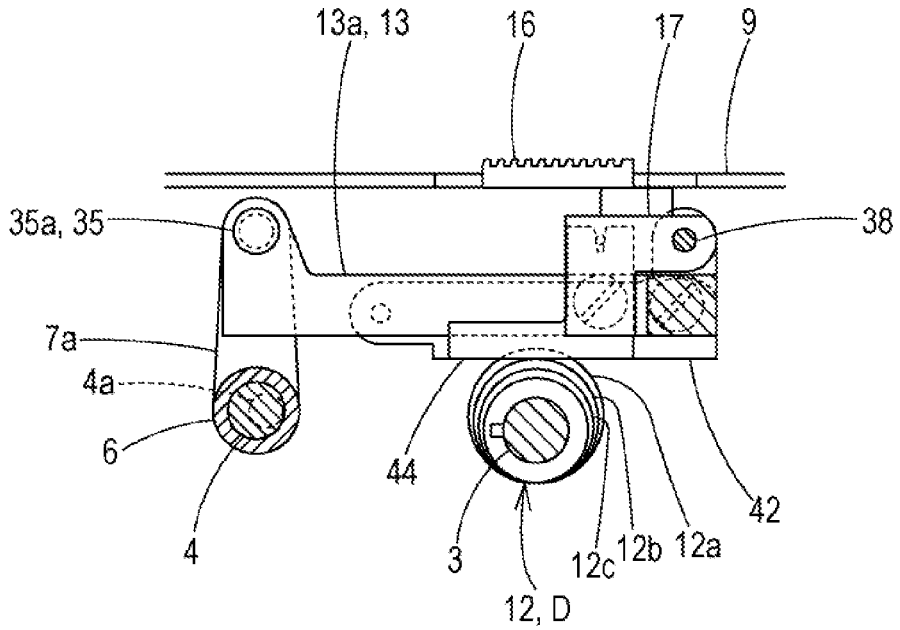
FIGS. 6A and 6B are cross-sectional arrow views taken along Z-Z in FIG. 3.
Figure 6B:
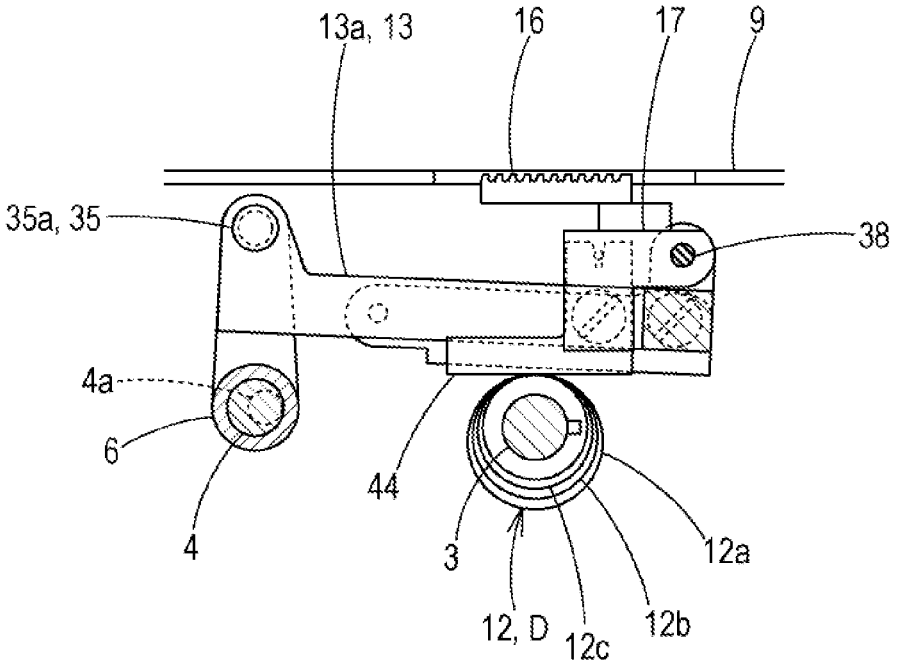

As illustrated in FIGS. 5A and 5B, the feed bar 13 having the pin 35 serving as the support point swings vertically while following the movement, of the feed bar plate 42 on which the cam surface (cam surface lib in the drawing) of the vertically moving cam 11 slides. Furthermore, as illustrated in FIGS. 6A and 6B, the sub feed bar 17 having the pin 38 serving as the support point and being pivotally supported by the pin 38 swings vertically while following the movement of the sub feed bar plate 44 on which the cam surface (cam surface 12*b* in the drawing) of the sub vertically moving cam 12 slides. Since the feed dog 16 is fixed to the sub feed bar 17, the feed dog 16 moves vertically on the sub feed bar 17 that is swung by the sub vertically moving cam 12 while having the pin 38, which is swung vertically by the vertically moving cam 11, serve as the support point. When the feed bar 13 and the sub feed bar 17 are supported by the largest cam diameter portions of the cam surfaces (11*b* and 12*b*) of their respective cams, the feed dog 16 protrudes from the upper surface of the needle plate 9 by a height of Hb (see FIG. 5A), and when supported by the smallest cam diameter portions of the cam surfaces (11*b* and 12*b*), the feed dog 16 retracts below the upper surface of the needle plate 9 (see FIG. 5B).

In the present exemplary embodiment, when the feed bar plate 42 is in contact with the portion near the largest cam diameter portion of the vertically moving cam 11, the feed bar 13 is substantially horizontal (see FIG. 5A), and when the feed bar 13 is in contact with the portion near the smallest cam diameter portion after rotation of the vertically moving cam 11, the feed bar 13 is inclined downward toward the front (see FIG, 5B). Meanwhile, the sub feed bar 17 pivots about the pin 38 such that the sub feed bar 17 is kept substantially horizontal even when the sub feed bar plate 44 is in contact with the portion near the smallest cam diameter portion of the sub vertically moving cam 12 so that the inclination of the sub feed bar 17 does not change (see FIG. 6B). In other words, upon rotation of the cam body D, even if the feed bar 13 is swung vertically having the pin 35 serving as the support point and the inclination of the feed bar 13 is changed, the inclination of the sub feed bar 17 on which the feed dog 16 is disposed does not change.

The reason why the inclination of the feed dog 16 does not change even if the inclination of the feed bar 13 changes is that the vertical motion of the pin 38 serving as the rotation center of the sub feed bar 17 provided on the feed bar 13 and the vertical motion of the sub feed bar 17 are in quantity and in phase, coincident. In other words, both of the cam surfaces are formed so that, when the cam body D rotates, the amount and the phase of the vertical motion of the pin 38 owing to the cam surface 11*a*, 11*b*, or 11*c* of the vertically moving cam 11 and the amount and the phase of the vertical motion of the contact between the cam surface 12*a*, 12*b*, or 12*c* of the sub vertically moving cam 12 and the lower end of the sub feed bar plate 44 coincide each other. As described above, with the coordination between the vertically moving cam 11 and the sub vertically moving cam 12, even if the inclination of the feed bar 13 changes, the inclination of the sub feed bar 17 on which the feed dog 16 is disposed do not change; accordingly, the predetermined inclination of the feed dog 16 can be maintained.

Operation of adjusting the inclination of the feed dog 16 of the present embodiment will be described next with reference to the drawings. To adjust the inclination of the feed dog 16, the feed rock shaft 4 is vertically moved by rotating the eccentric shafts 4*a* that each have a rotation center that is eccentric with respect to the center of the feed rock shaft 4. As illustrated in FIG. 1A, in order to tilt the horizontal feed dog 16 illustrated in FIG. 4A downward toward the front, the eccentric shafts 4*a* are rotated in the counterclockwise direction (an arrow L direction in the drawing). With the rotation of the eccentric shafts 4*a* that are supported by the sewing machine frame, the feed rock shaft 4 moves upwards and, accordingly, together with the bearing 6 for the feed rock shaft and the feed rock shaft cranks 7, the pins 35 move upwards such that the feed bar 13 and the sub feed bar 17 incline downward toward the front and the feed dog 16 on the sub feed bar 17 is inclined downward toward the front as well. While the drawing illustrates a state in which the eccentric shafts 4*a* are rotated about 60°, the inclination of the feed dog 16 can be adjusted by the angle in which the eccentric shafts 4*a* are rotated.

Figure 7A:
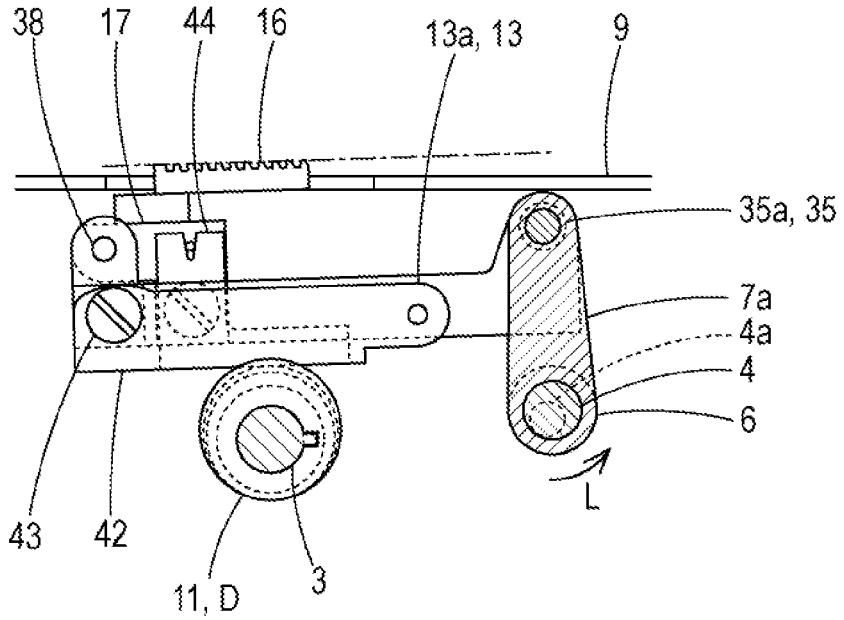
FIGS. 7A and 7B are cross-sectional arrow views of when the inclination of the feed dog is adjusted and are views taken along X-X in FIG. 3.
Figure 7B:
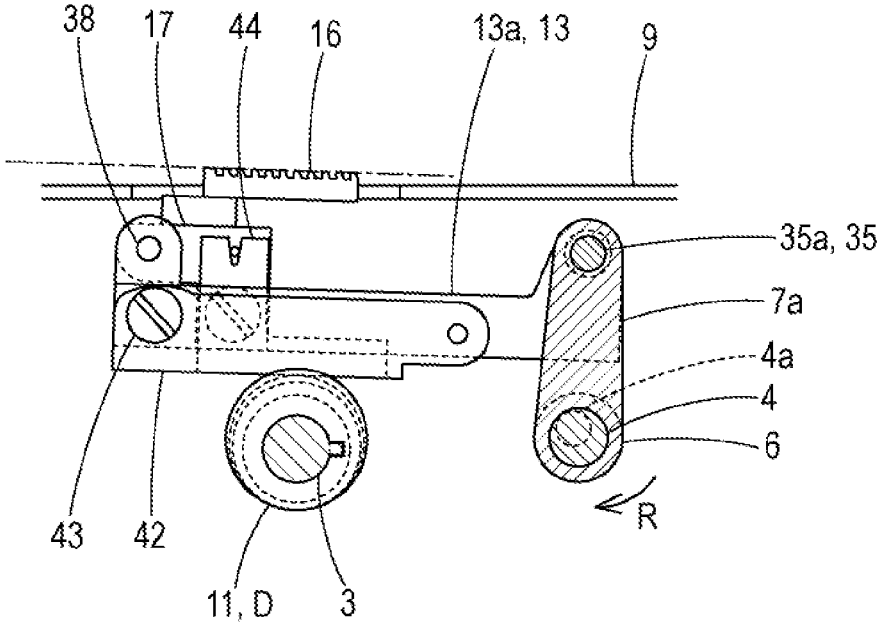

On the other hand, in order to incline the feed dog 16 upward toward the front, as illustrated in FIG. 7B, the eccentric shafts 4*a* are rotated in the clockwise direction (an arrow R direction in the drawing) and the feed rock shaft 4 is moved downwards such that the feed bar 13 and the sub feed bar 17 are inclined upward toward the front. As described above, in order to rotate the eccentric: shafts 4*a*, the stepping motor 5 for adjusting the inclination of the feed dog is rotationally driven. As illustrated in FIG. ISA, by operating the touch panel 70 or the like that is disposed in the sewing machine body, the stepping motor 5 can be rotationally driven so that the feed dog 16 is inclined as required.

Figure 14:
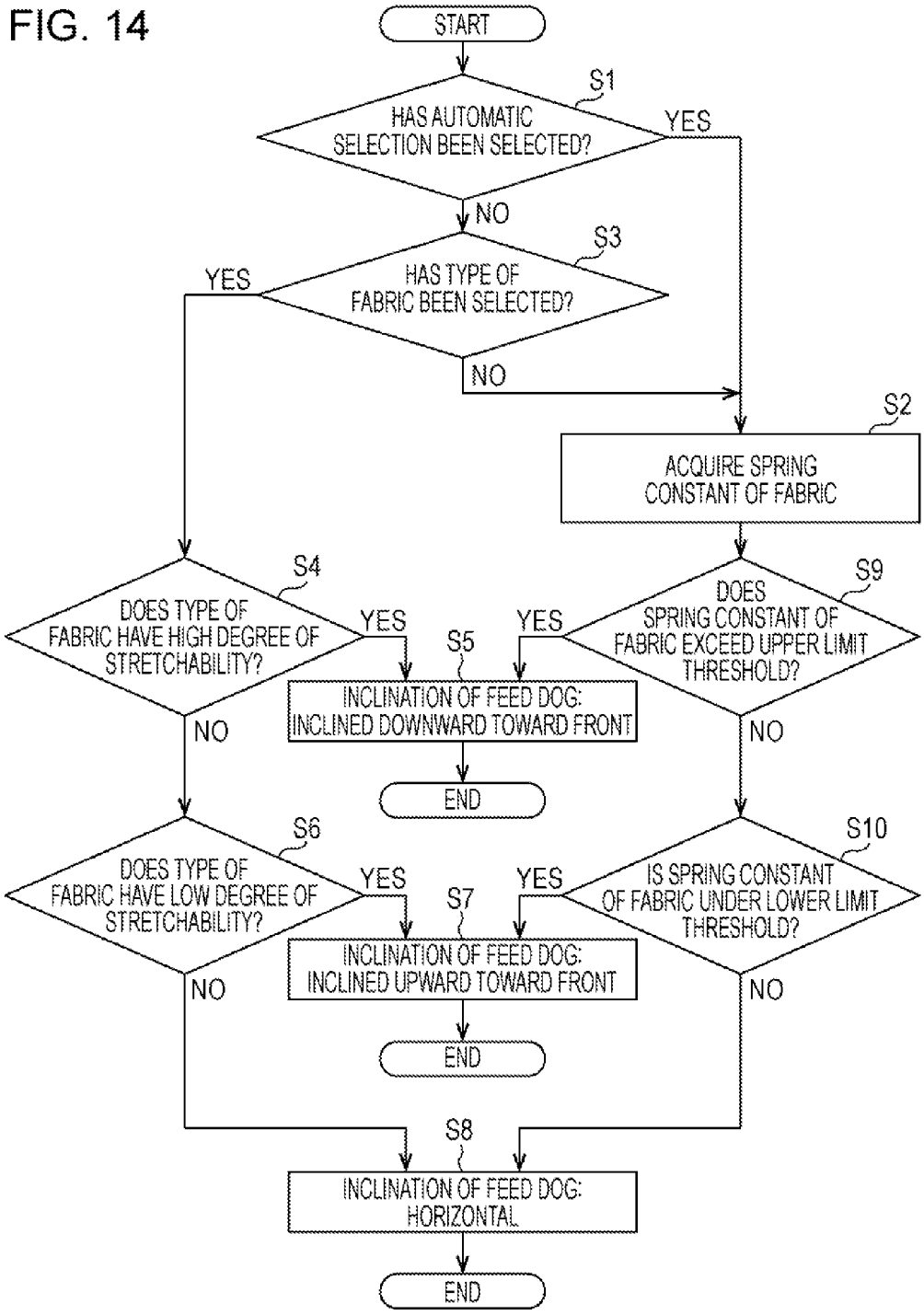
FIG. 14 is a flowchart illustrating an operation sequence of adjusting the inclination of the feed dog of the feed dog adjustment device of the exemplary embodiment.

The display of the touch panel 70 illustrated in FIG. 13A is an example. When a "FABRIC TYPE SELECTION" key in the menu display is selected, a display as in the drawing is displayed. As illustrated in FIG. 14, when an operator operates the touch panel display and selects an "AUTOMATIC SELECTION" key (S1: YES), the controller 80, based on a predetermined program, descends the presser bar 26 with the stepping motor 27 for driving the pressor bar, and acquires data of a spring constant of the fabric N by calculating the spring constant, from the descended amount of the presser lever 53 and the descended amount of the presser bar 26 that are detected at a predetermined timing (S2).

When the operator selects the "FABRIC TYPE SELECTION" key (S3: YES) and determines that the sewn fabric N is included in a group of fabric types that, have a high degree of stretchability or that easily shrinks by sewing and selects a "HIGH DEGREE OF STRETCHABILITY" key (S4: YES), the controller 80 starts a program that inclines the feed dog 16 downward toward the front (S5) and drives the stepping motor 5 for adjusting the inclination of the feed dog so that the feed dog 16, which is normally set horizontally, is oriented downward toward the front. When the operator determines that the sewn fabric N is included in a group of fabric that has a low degree of stretchability and selects a "LOW DEGREE OF STRETCHABILITY" key (S6: YES), the controller 80 starts a program that inclines the feed dog 16 upward toward the front (S7) and drives the stepping motor 5 for adjusting the inclination of the feed dog so that the feed dog 16 is oriented upward toward the front. When neither of the "HIGH DEGREE OF STRETCHABILITY" key nor the "LOW DEGREE OF STRETCHABILITY" key is selected (S6: NO), the inclination of the feed dog 16 is adjusted so as to be kept horizontal.

In a case in which the spring constant of the fabric N is acquired in step 2 (S2), and when the acquired spring constant exceeds an upper limit threshold of a predetermined range (S9: YES), a program that sets the inclination of the feed dog 16, which is normally set horizontal, downward toward the front is started (S5), and the stepping motor 5 for adjusting the inclination of the feed dog is driven so that the feed dog 16 is oriented downward toward the front. When the spring constant is under an upper limit threshold of the predetermined range (S10: YES), a program that sets the inclination of the feed dog 16 upward toward the front is started (S7), and the stepping motor 5 for adjusting the inclination of the feed dog is driven so that the feed dog 16 is oriented upward toward the front. When the spring constant is within the predetermined range (S10: NO), the inclination of the feed dog 16 is adjusted so as to be kept horizontal.

Figure 12A:
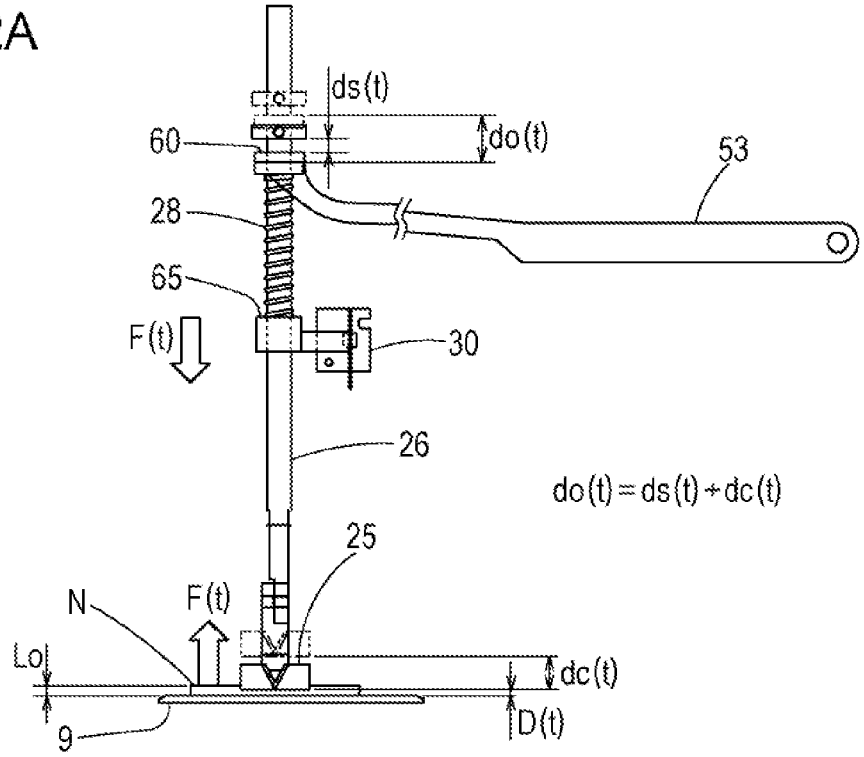
FIG. 12A is a diagram illustrating a state in which, after the fabric N is pressed by the lowered presser bar of the sewing machine of the exemplary embodiment, the fabric N is compressed from a fabric thickness Lo, which is a thickness when in a non-loaded state, to a height (8t) of the presser foot.
Figure 12B:
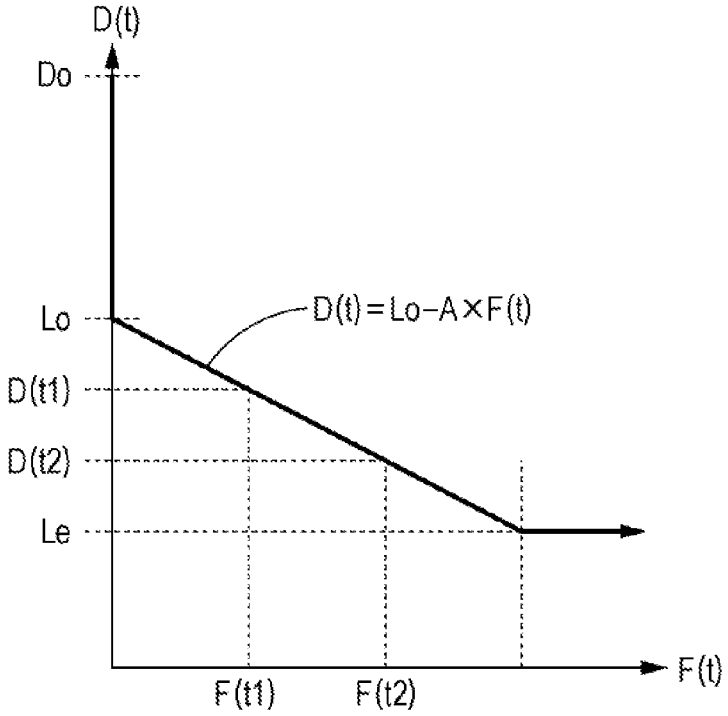
FIG. 12B is a graph illustrating a relationship between the height D(t) of the pressor foot and the load F(t) of the spring.

Referring to FIGS. 12A and 12B, the method of acquiring the spring constant of the fabric N will be described next. The controller 80 starts a program of acquiring the spring constant of the fabric N and drives the stepping motor 27 for driving the presser bar to descend the presser bar 26. The thickness of the fabric N when there is no load is Lo, and until the presser foot 25 reaches the surface of the fabric N, the presser bar 26 descends together with the presser lever 53. As illustrated in FIG. 12A, when the presser lever 53 is further descended, the fabric N becomes compressed and repulsive force F(t) of the fabric N at a timing (t) acts on the presser bar 26. A load F(t) that is equivalent to the repulsive force F(t) acts on the spring 28 and the spring 28 is compressed by ds(t).

In the above case, the following relational expression holds true between a descended amount do(t) of the presser lever 53, the descended amount dc(t) of the pressor bar 26, and the compressed amount ds(t) of the spring 28.

$$do(t)=ds(t)+dc(t) \quad (1)$$

Furthermore, the relationship between the thickness (the height of the presser foot 25) D(t) of the compressed fabric N and the repulsive force F(t) of the fabric N can be expressed by the following relational expression (2), and when the spring constant of the spring 28 is ks, the relational expression can be deformed into relational expressions (3) and (4). Sign A is a constant.

$$D(t)=Lo-A\times F(t) \quad (2)$$

$$D(t)=Lo-A\times\{ks\times ds(t)\} \quad (3)$$

$$D(t)=Lo-A\times[ks\times\{do(t)-dc(t)\}] \quad (4)$$

FIG. 12B illustrates the relationship between the thickness (the height of the presser foot 25) D(t) of the compressed fabric N and the repulsive force F(t) of the fabric N illustrated by way of a graph. The descended amount do(t) of the presser lever 53 is detected by the rotation amount of the stepping motor 27 for driving the presser bar, and the descended amount dc(t) of the presser bar 26 is detected by the height detection sensor 30. Furthermore, since the spring constant ks of the spring 28 can be measured in advance, by measuring the descended amounts do(t1) and do(t2) of the pressor lever 53 at two different timings t1 and t2, respectively, and the descended amounts dc(t1) and dc(t2) of the presser bar 26, simultaneous equations can be generated from the above equation (4) and the unknown quantities Lo and A can be calculated.

As described above, since the repulsive force of the compressed fabric N and the load on the spring 28 are F(t) and are equivalent, when the timing at which the presser foot 25 comes into contact with the fabric N is tp and the spring constant of the fabric N is kc, the following relational expression holds true.

$$ks\times\{do(tp+t)-dc(tp+t)\}=kc\times\{dc(tp+t)-dc(tp)\} \quad (5)$$

Since the descended amount dc(tp) of the presser bar 26 at the timing tp can be calculated from Lo that has been calculated earlier, by measuring the descended amount do(tp+t) of the presser lever 53 and the descended amount dc(tp+t) of the presser bar 26 at a predetermined timing (tp+t), the spring constant kc of the spring constant kc of the fabric N can be calculated. Note that the above description is an example of the method for acquiring the spring constant of the fabric N and the present disclosure is not limited to the above method.

An operation of changing the height of the feed dog 16 according to the thickness of the fabric N will be described next with reference to the drawings. In the present exemplary embodiment, in order to enable the height of the feed dog 16 to be changed according to the thickness of the sewn fabric N, a plurality of cam surfaces (11*a*, 11*b*, and 11*c*), (12*a*, 12*b*, and 12*c*) that have different largest cam diameters are provided in the vertically moving cam 11 and the sub vertically moving cam 12, respectively, and by sliding the cam body D in the axial direction with respect to the lower shaft 3, a pair of cam surfaces that correspond to each other and that support the feed bar 13 and the sub feed bar 17 can be selected from the plurality of cam surfaces (11*a*, 11*b*, and 11*c*), (12*a*, 12*b*, and 12*c*) of both cams.

Figure 8A:
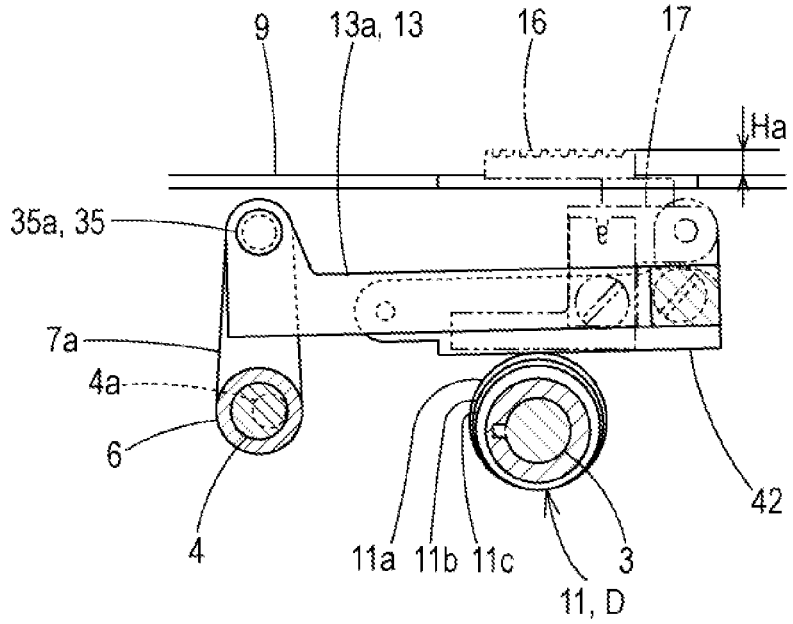
FIGS. 8A and 8B are cross-sectional arrow views of when the height of the feed dog is adjusted and are views taken along Y1-Y1 in FIG. 3.
Figure 8B:
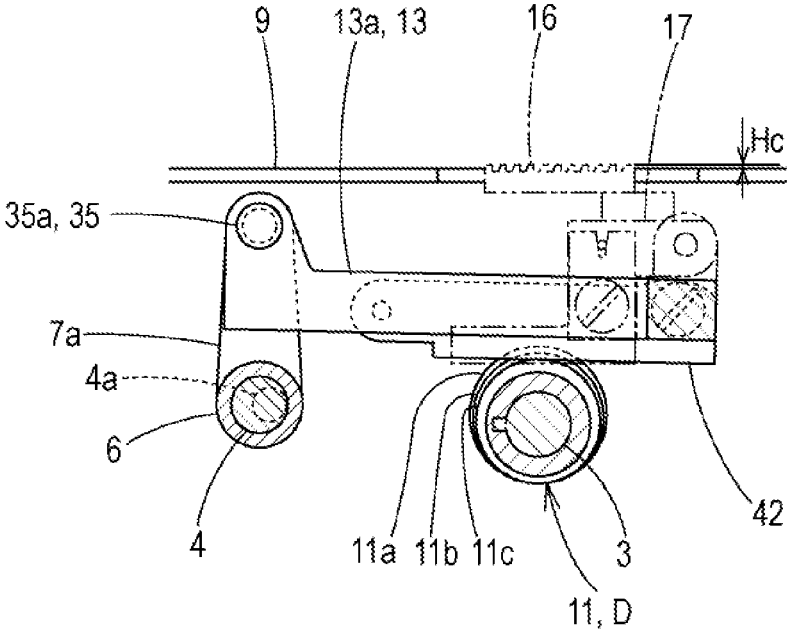

As illustrated in FIG. 8A, when the thickness of the fabric N is large, the stepping motor 18 for adjusting the height of the feed dog is driven to slide the cam body D in the axial direction with respect to the lower shaft 3 so that the cam surface 11*a* of the vertically moving cam 11 that has the largest largest cam diameter is in contact with the feed bar plate 42; accordingly, the height of the feed dog 16 is set high to Ha. At this point, although not illustrated, the sub feed bar plate 44 is in contact with the cam surface 12*a* of the sub vertically moving cam 12 that has the largest largest cam diameter. Furthermore, as illustrated in FIG. 8B, when the thickness of the fabric N is small, the cam body D is slid in the axial direction with respect to the lower shaft 3 so that the cam surface 11*c* of the vertically moving cam 11 that has the smallest largest cam diameter is in contact with the feed bar plate 42 and so that the cam surface 12*c* of the sub vertically moving cam 12 that has the smallest largest cam diameter is in contact with the sub feed bar plate 44; accordingly, the height of the feed dog 16 is set low to He. Note that as described above, the vertically moving cam 11 and the sub vertically moving cam 12 do not necessarily have to be formed integrally as long as both cams are driven in a coordinated manner.

The height of the feed dog 16 can be adjusted by the user operating the touch panel 70; however, in the present exemplary embodiment, the height of the feed dog 16 can be adjusted by the controller 80 automatically determining an appropriate feed dog height on the basis of the measurement result of the height detection sensor 30 and driving the stepping motor 18 for adjusting the height of the feed dog. As illustrated in FIG. 10A, the thickness h of the fabric N when the fabric N is pressed at a predetermined compressive force with the spring 28 by rotating the stepping motor 27, which is for driving the presser bar, a predetermined amount can be calculated by detecting the descended amount of the presser bar 26 with the height detection sensor 30.

The descended amount of the presser bar 26 is calculated by, after the presser bar 26 is descended, integrating the number of slits detected from when a slit 66 of the slit plate 30*a* is first detected by the transmission optical sensor 30*b* illustrated in FIG. 10B. Since the thickness h of the fabric N can be calculated by subtracting the descended amount of the presser bar 26 from the initial height of the presser foot 25, as illustrated in FIG. 10B, ultimately, the ranges E1, E2, and E3 of the slits 66 that are detected by the transmission optical sensor 30*b* correspond to the ranges that distinguish the thickness of the fabric N, namely, a range of a piece of heavyweight fabric with a thickness h1 illustrated in FIG. 11A, a range of a piece of fabric with an intermediate thickness h2 illustrated in FIG. 11B, and a range of a piece of lightweight fabric with a thickness h3 illustrated in FIG. 11C, respectively.

Figure 15:
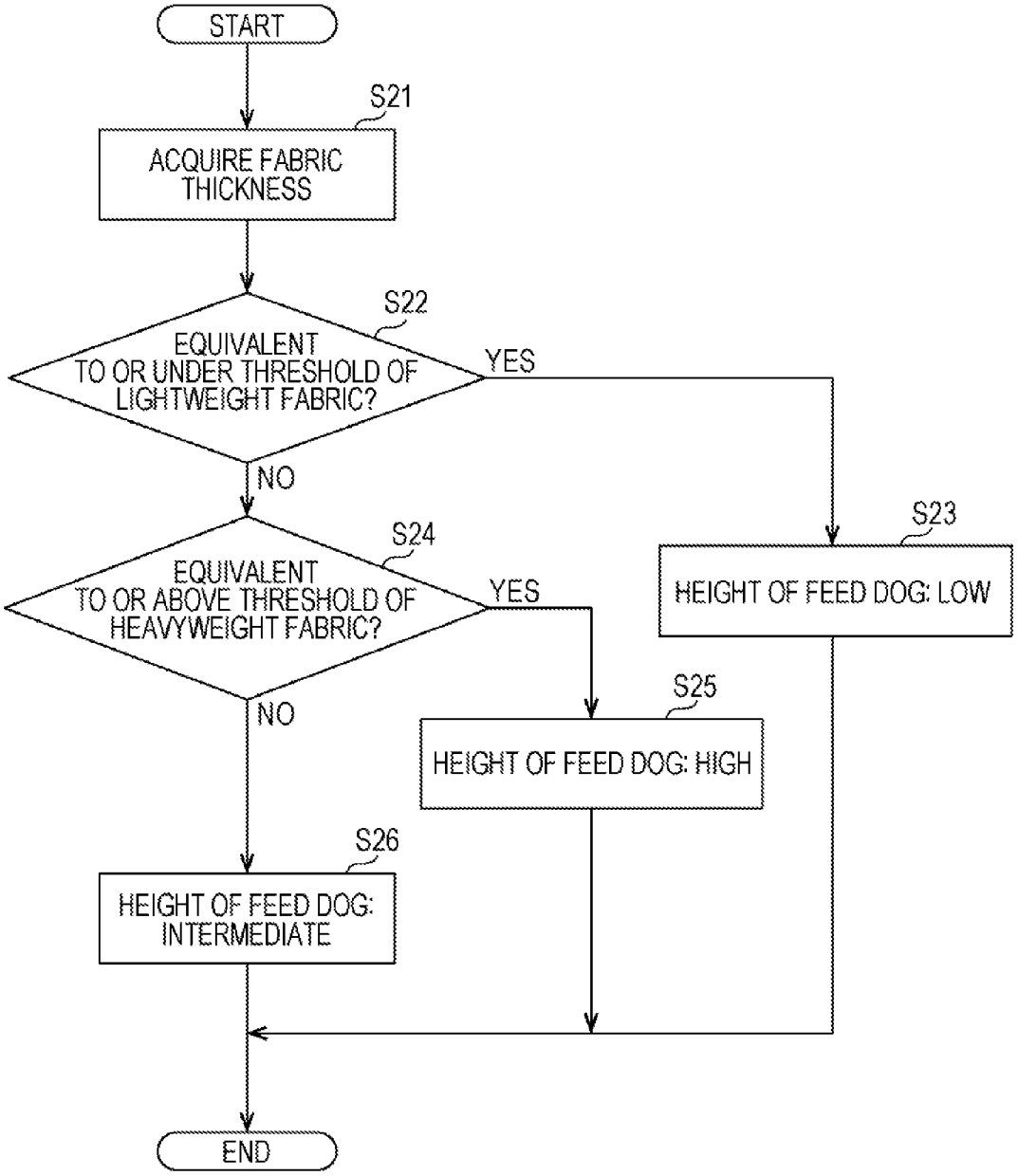
FIG. 15 is a flowchart illustrating an operation sequence of adjusting the height of the feed dog of the feed dog adjustment device of the exemplary embodiment.

As illustrated in FIG. 15, in order to adjust the height of the feed dog 16, after acquiring thickness data of the fabric N from the results of the measurement taken by the height detection sensor 30 (S21), when the thickness data is equivalent to or under a threshold of a piece of lightweight fabric (S22: YES), as illustrated in FIG. 8B, the stepping motor 18 for adjusting the height of the feed dog is driven and the cam body D is slid in the axial direction with respect to the lower shaft 3 such that the height of the feed dog 16 is adjusted to a low degree, that is, to Hc (S23). Furthermore, when the thickness data is equivalent to or above a threshold of a piece of heavyweight fabric (S24: YES), as illustrated in FIG. 8A, the stepping motor 18 for adjusting the height of the feed dog is driven such that the height of the feed dog 16 is adjusted to a high degree, that is, to Ha (S25).

When the thickness data exceeds the threshold of a piece of lightweight fabric N is under a threshold of a piece of heavyweight fabric (S24: NO), as illustrated in FIG. 5A, the height of the feed dog 16 is adjusted to an intermediate degree, that is, to Hb (S26). Note that in the present exemplary embodiment, the thickness of the fabric N that has been compressed at a predetermined pressure is calculated as the fabric thickness data from data detected by the height detection sensor 30 alone; however, adjustment of the height of the feed dog can be performed in a further appropriate manner by, as described above in the method of acquiring the spring constant of the fabric N, calculating the descended amount of the presser lever 53 from the data of the rotation amount of the stepping motor 27 for driving the presser bar and by calculating, with the relational expression (4) described above, the thickness Lo of the fabric when there is no load applied thereto from the descended amount of the presser lever 53 and the descended amount of the presser bar 26 at two different timings t1 and t2, as the fabric thickness data.

Is it is apparent from the configuration of the sub feed bar 17 having a rotation center in the feed bar 13 and the configuration of the sub vertically moving cam 12 that vertically swings the sub feed bar 17, the operation and the control of adjusting the inclination of the feed dog 16 of the present exemplary embodiment and the operation and the control of adjusting the height of the feed dog 16 can be performed individually. In other words, as described above, each of the plurality of cam surfaces (11*a*, 11*b*, and 11*c*) of the vertically moving cam 11 and the corresponding one of the plurality of cam surfaces (12*a*, 12*b*, and 12*c*) of the sub vertically moving cam 12 are formed so that, even if the feed bar 13 changes its inclination by being swung vertically with the pins 35 serving as the support points, the inclination of the sub feed bar 17 on which the feed dog 16 is disposed do not change; accordingly, as illustrated in FIGS. 7 A and 7B, after adjusting the inclination of the feed dog 16 to a predetermined inclination, even if the cam body D is slid in the axial direction with respect to the lower shaft 3 in order to change the cam surfaces of both cams and change the height of the feed dog 16, the inclination of the adjusted feed dog 16 does not change.

Furthermore, as illustrated in FIG. 3, since in a normal positional relationship, the lower shaft 3 (the vertically moving cam 11 and the sub vertically moving cam 12) and the feed dog 16 that are disposed inside the small bed portion 400 are positioned at substantially the same position in plan view, the effect of change in the inclination of the feed dog 16 on the height of the feed dog 16 is insignificant; accordingly, even if the inclination of the feed dog 16 is changed after the height of the feed dog 16 has been changed, there is almost no effect on the height of the feed dog 16. Accordingly, in the present exemplary embodiment, the height adjustment and the inclination adjustment of the feed dog 16 can be controlled independently and the order of the operation is not restricted to any order. Accordingly, in a case in which the fabric has a high degree of stretchability and is a piece of lightweight fabric, for example, by setting the inclination of the feed dog 16 downward towards the front and by adjusting the height of the feed dog 16 low, a synergistic effect in preventing shrinkage by sewing can be exerted and a favorable result can be expected.

Moreover, in the present exemplary embodiment, by mere operation of the touch panel 70 by the operator, data related to the thickness, type, and stretchability of the sewn fabric can be acquired and the inclination and height of the feed dog 16 can be adjusted automatically by driving the stepping motors 5 and 18 for adjustment; accordingly, a sewing machine including the feed dog adjustment device that is extremely easy to use can be provided, The feed dog adjustment device and the sewing machine including the adjustment device of the present disclosure are capable of automatically adjusting the inclination of the feed dog to a state appropriate for the sewn fabric, can be widely used for household sewing machines and industrial sewing machines, and are easy to use.

What is claimed is:

1. A feed dog adjustment device, comprising:

a feed rock shaft rotatably attached to a sewing machine frame with an eccentric shaft provided at an eccentric position with respect to a center;

a feed rock shaft crank that slides about the feed rock shaft a feed bar rotatably attached to the feed rock shaft crank;

a feed dog provided on the feed bar;

an actuator for inclination adjustment that rotates the eccentric shaft;

a controller that drives the actuator for inclination adjustment to adjust an inclination of the feed dog on a basis of data related to a type and stretchability of fabric;

a lower shaft rotatably attached to the sewing machine frame;

a vertically moving cam that includes a plurality of cam surfaces that have different largest cam diameters and that is fitted around the lower shaft so as to be slidable in an axial direction of the lower shaft, the vertically moving cam supporting and vertically swinging the feed bar;

a sub feed bar rotatably attached to the feed bar, the feed dog being fixed to the sub feed bar;

a sub vertically moving cam that includes a plurality of cam surfaces that have different largest cam diameters and that is fitted around the lower shaft so as to be slidable in the axial direction of the lower shaft, the sub vertically moving cam supporting and vertically swinging the sub feed bar; and an actuator for height adjustment that slides the vertically moving cam and the sub vertically moving cam in the axial direction with respect to the lower shaft, wherein a cam surface of the plurality of cam surfaces of the vertically moving cam that supports the feed bar and a cam surface of the plurality of cam surfaces of the sub vertically moving cam that supports the sub feed bar are capable of being selected.

2. The feed dog adjustment device according to claim 1, wherein the cam surface of the vertically moving cam that has been selected to support the feed bar and the cam surface of the sub vertically moving cam that has been selected to support the sub feed bar are formed such that a vertical motion of a rotation center of the sub feed bar on the feed bar and a vertical motion of a contact between the sub vertically moving cam and the sub feed bar are coincident with respect to each other in quantity and in phase.

3. The feed dog adjustment device according to claim 1, further comprising:

a presser bar supported by the sewing machine frame so as to be capable of sliding vertically;

a presser foot attached to a lower end portion of the presser bar; and a height detection sensor that acquires data related to a thickness of the fabric by detecting a height of the presser bar, wherein the controller drives the actuator for height adjustment to adjust the height of the feed dog on a basis of data related to the thickness of the fabric.

4. The feed dog adjustment device according to claim 3, further comprising:

a presser lever that presses the presser bar while having a spring in between, wherein a controller calculates data on a difference between a descended amount of the presser lever when the presser bar compresses the fabric with the presser foot and a descended amount of the presser bar, and on a basis of the data that has been calculated, adjusts the inclination of the feed dog by driving the actuator for inclination adjustment.

5. The feed dog adjustment device according to claim 2, further comprising:

a presser bar supported by the sewing machine frame so as to be capable of sliding vertically;

a presser foot attached to a lower end portion of the presser bar; and a height detection sensor that acquires data related to a thickness of the fabric by detecting a height of the presser bar, wherein the controller drives the actuator for height adjustment to adjust the height of the feed dog on a basis of data related to the thickness of the fabric.

6. The feed dog adjustment device according to claim 5, further comprising:

a presser lever that presses the presser bar while having a spring in between, wherein the controller calculates data on a difference between a descended amount of the presser lever when the presser bar compresses the fabric with the presser foot and a descended amount of the presser bar, and on a basis of the data that has been calculated, adjusts the inclination of the feed dog by driving the actuator for inclination adjustment.

7. A sewing machine, comprising:

a feed dog adjustment device, wherein the feed dog adjustment device includes a feed rock shaft rotatably attached to a sewing machine frame with an eccentric shaft provided at an eccentric position with respect to a center, a feed rock shaft crank that slides about the feed rock shaft, a feed bar rotatably attached to the feed rock shaft crank, a feed dog provided on the feed bar, an actuator for inclination adjustment that rotates the eccentric shaft, and a controller that drives the actuator for inclination adjustment to adjust an inclination of the feed dog on a basis of data related to a type and stretchability of fabric;

a lower shaft rotatably attached to the sewing machine frame;

a vertically moving cam that includes a plurality of cam surfaces that have different largest cam diameters and that is fitted around the lower shaft so as to be slidable in an axial direction of the lower shaft, the vertically moving cam supporting and vertically swinging the feed bar;

a sub feed bar rotatably attached to the feed bar, the feed dog being fixed to the sub feed bar;

a sub vertically moving cam that includes a plurality of cam surfaces that have different largest cam diameters and that is fitted around the lower shaft so as to be slidable in an axial direction of the lower shaft, the sub vertically moving cam supporting and vertically swinging the sub feed bar; and an actuator for height adjustment that slides the vertically moving cam and the sub vertically moving cam in the axial direction with respect to the lower shaft, wherein a cam surface of the plurality of cam surfaces of the vertically moving cam that supports the feed bar and a cam surface of the plurality of cam surfaces of the sub vertically moving cam that supports the sub feed bar are capable of being selected.

8. The sewing machine according to claim 7, wherein the cam surface of the vertically moving cam that has been selected to support the feed bar and the cam surface of the sub vertically moving cam that has been selected to support the sub feed bar are formed such that a vertical motion of a rotation center of the sub feed bar on the feed bar and a vertical motion of a contact between the sub vertically moving cam and the sub feed bar are coincident with respect to each other in quantity and in phase.

9. The sewing machine according to claim 7, further comprising:

a presser bar supported by the sewing machine frame so as to be capable of sliding vertically;

a presser foot attached to a lower end portion of the presser bar; and a height detection sensor that acquires data related to a thickness of the fabric by detecting a height of the presser bar, wherein the controller drives the actuator for height adjustment to adjust the height of the feed dog on a basis of data related to the thickness of the fabric.

10. The sewing machine according to claim 9, further comprising:

a presser lever that presses the presser bar while having a spring in between, wherein the controller calculates data on a difference between a descended amount of the presser lever when the presser bar compresses the fabric with the presser foot and a descended amount of the presser bar, and on a basis of the data that has been calculated, adjusts the inclination of the feed dog by driving the actuator for inclination adjustment.

11. The sewing machine according to claim 8, further comprising:

a presser bar supported by the sewing machine frame so as to be capable of sliding vertically;

a presser foot attached to a lower end portion of the presser bar; and a height detection sensor that acquires data related to a thickness of the fabric by detecting a height of the presser bar, wherein the controller drives the actuator for height adjustment to adjust the height of the feed dog on a basis of data related to the thickness of the fabric.

12. The sewing machine according to claim 11, further comprising:

a presser lever that presses the presser bar while having a spring in between, wherein a controller calculates data on a difference between a descended amount of the presser lever when the presser bar compresses the fabric with the presser foot and a descended amount of the presser bar, and on a basis of the data that has been calculated, adjusts the inclination of the feed dog by driving the actuator for inclination adjustment.

* * * * *